United States Patent [19]

Yonkers

[11] 3,978,539

[45] Sept. 7, 1976

[54] FLOOR SWEEPER WITH AUXILIARY ROTARY BRUSHES

[75] Inventor: Robert A. Yonkers, Grandville, Mich.

[73] Assignee: Bissell, Inc., Grand Rapids, Mich.

[22] Filed: June 30, 1975

[21] Appl. No.: 591,870

[52] U.S. Cl. ..... 15/42

[51] Int. Cl.[2] ..... A47L 11/33

[58] Field of Search ..... 15/42, 87

[56] References Cited

UNITED STATES PATENTS

| | | | |
|---|---|---|---|
| 500,976 | 7/1893 | Tangenberg | 15/42 |
| 3,748,679 | 7/1973 | Rosendall | 15/42 |
| 3,750,215 | 8/1973 | Liebscher | 15/42 |
| 3,874,016 | 4/1975 | Liebscher | 15/42 |

FOREIGN PATENTS OR APPLICATIONS

| | | | |
|---|---|---|---|
| 2,055,841 | 9/1974 | Germany | 15/42 |

*Primary Examiner*—Edward L. Roberts

*Attorney, Agent, or Firm*—Andrus, Sceales, Starke & Sawall

[57] ABSTRACT

A floor sweeper having, in addition to its main brush roller, one or more auxiliary brushes for sweeping debris into the path of the main brush. Each auxiliary brush includes a brush body having an annular array of outwardly downwardly inclined brush bristles. A flexible drive ring is mounted concentric to said bristles and adjacent the roots thereof on the underside of the brush body. Both the ring and bristle tips are disposed in fixed parallel planes and the assembly is mounted on an axis which is fixed and inclined from the vertical in a manner so that the rearward brush edge will, upon forward sweeper movement, rotate transversely inwardly beneath the sweeper housing with a debris disturbing and flicking action. Downward force on the sweeper causes the drive ring to deform upwardly and to deflect the adjacent bristles in a direction away from the carpet to keep the brush-carpet friction forces generally equalized.

14 Claims, 6 Drawing Figures

Fig. 1
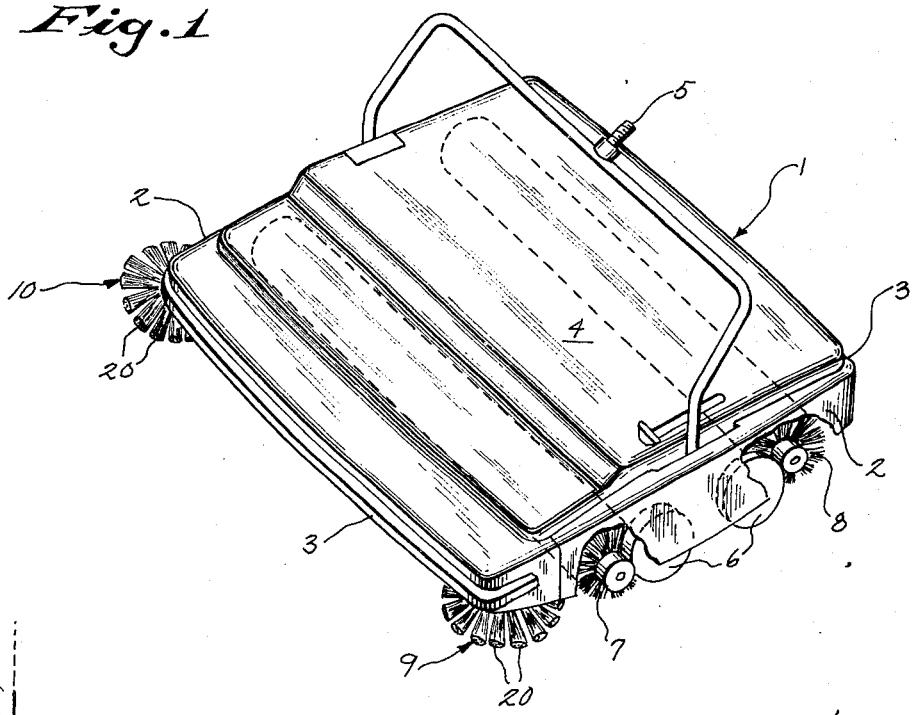
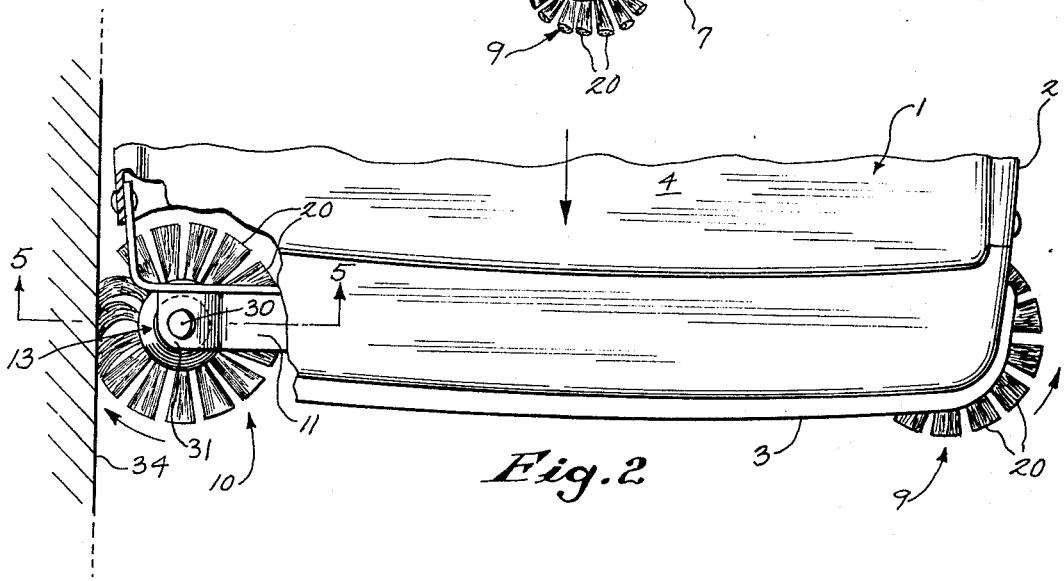
Fig. 2
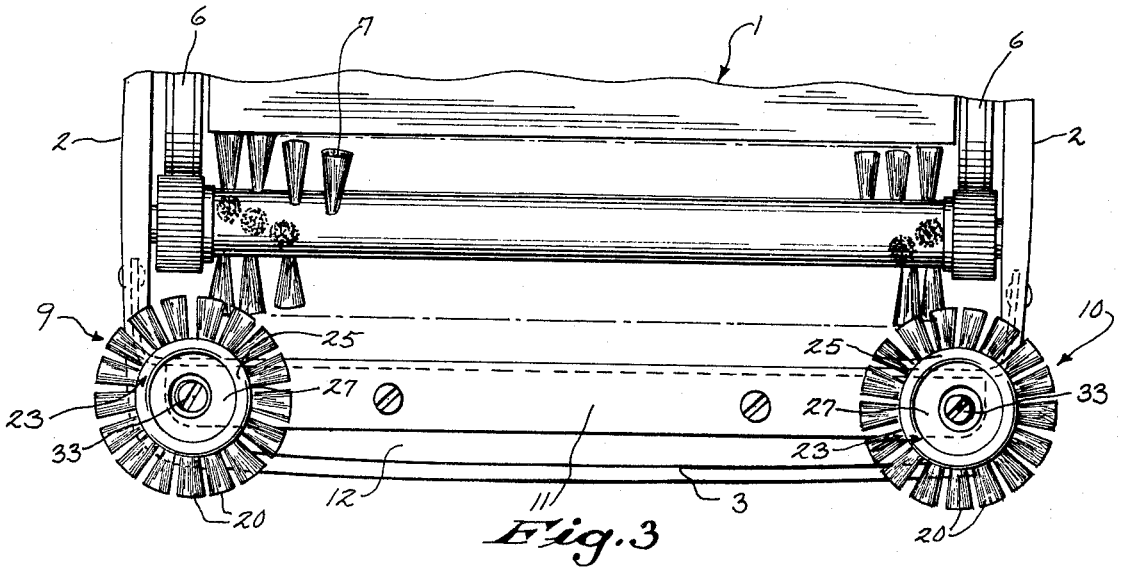
Fig. 3

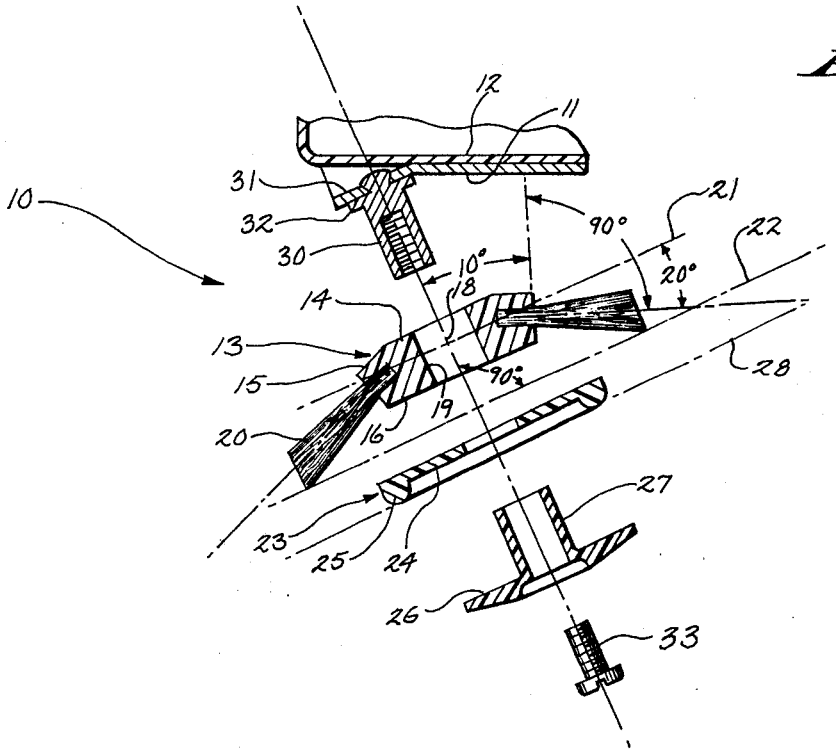
Fig.4
Fig.5
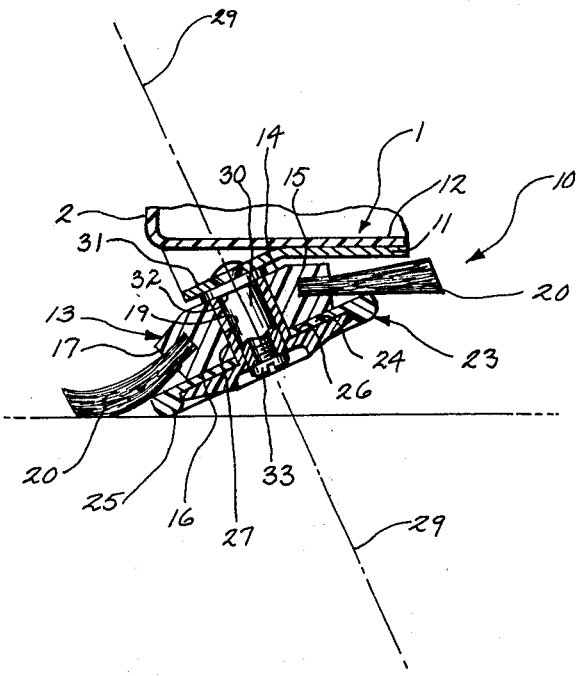
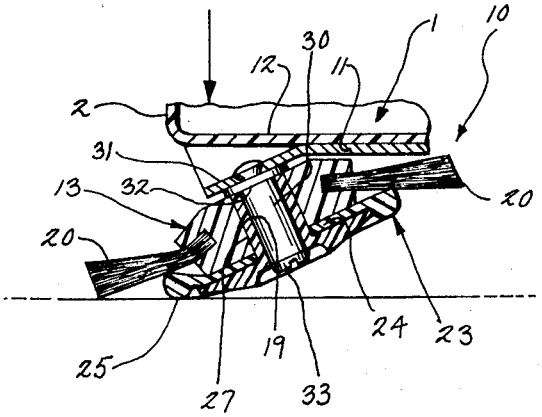
Fig.6

FLOOR SWEEPER WITH AUXILIARY ROTARY BRUSHES

PRIOR ART OF INTEREST

| U. S. Patents | | |
|---|---|---|
| 500,976 | July 4, 1893 | Tangenberg |
| 3,748,679 | July 31, 1973 | Rosendall |
| 3,750,215 | August 7, 1973 | Liebscher (I) |
| 3,874,016 | April 1, 1975 | Liebscher (II) |
| **German Patents** | | |
| Petty 7,324,485 | July 3, 1973 | Leifheit |
| Full 2,055,841 | November 8, 1973 | Haaga |

BACKGROUND OF THE INVENTION

This invention relates to floor sweepers, particularly carpet sweepers, which in addition to the usual brush roller, are provided with auxiliary rotary brushes at the front of the sweeper frame for sweeping debris into the path of the brush roller.

Broadly, such auxiliary brushes are already known, as in the above referred to patents. For example, in the very early days of carpet sweepers, it was already suggested to mount an auxiliary brush having an annular array of bristles on a fixed axis which was inclined slightly from the vertical. See the U.S. Pat. 500,976. In the sweeper of that patent, the auxiliary brush drive connects from the top of the auxiliary brush body ad through a suitable shaft to a special drive wheel located centrally beneath the housing. Such a sweeper is expensive to manufacture and repair.

It is also known to rotatably drive the auxiliary brush body from an external drive wheel and wherein the brush is mounted to tilt fore and aft on a horizontal axis in accordance with the direction of sweeper movement. See the U.S. Pat. 3,750,215. This type of structure is also complex and expensive.

Other known auxiliary brush devices have attempted to simplify the drive structure by eliminating the external drive and instead providing a rotary drive for the auxiliary brush which is disposed within the confines of the annular bristles and which engages the floor beneath the brush body. Thus, it is known to drive the brush by means of an angular gear wheel disposed within the brush and which engages the floor. See the German Pat. No. 2,055,841. In that sweeper, the entire brush assembly swivels about a vertical axis during fore and aft sweeper movement. The resulting structure is heavy and relatively costly to produce.

It is also known to drive the brush from a spring loaded wheel beneath the brush body and to also tilt the entire brush assembly about a horizontal axis. See the U.S. Pat. No. 3,874,016. This structure is also complex and expensive to manufacture.

Several drives which have been further simplified are also presently known. For example, in German Petty Pat. No. 7324485, an auxiliary brush is mounted on a fixed vertical axis and the body thereof is provided with the usual annular array of sweeping bristles. A second array of inclined bristles is disposed inwardly of the sweeping bristles and is intended to drive the latter by contact with the floor. This construction is subject to several disadvantages. Not only do the second set of bristles substantially increase the cost of the assembly, but also it has been found that this brush tends to stall on the carpet during normal sweeper use, thus making the brush substantially unusable.

Another example of simplified auxiliary brush is shown in U.S. Pat. No. 3,748,679, wherein the brush body freely floats along the inclined shaft of a caster wheel and with the latter driving the brush through a non-circular connection. It has been found that this known structure, while performing relatively well under normal circumstances, does have at least one disadvantage. When the sweeper is moved along a wall in an attempt to remove debris at the floor-wall edge, the brush tends to stall when it contacts the wall.

To the knowledge of the inventor, the auxiliary brushes of the known devices have, upon forward sweeper movement, turned so that their forward edges rotated transversely inwardly and then rearwardly to beneath the sweeper housing. That is, viewed from the top, the right front corner brush has rotated counterclockwise and the left front corner brush clockwise. This has previously been thought to be desirable to obtain sweeping of the debris along a wall inwardly into the path of the brush roller.

SUMMARY OF THE INVENTION

The purpose of the present invention is to provide a manual floor sweeper, usually called a carpet sweeper, on which is mounted at least one rotary brush which is auxiliary to the usual brush roller, and which is substantially simplified from known auxiliary brushes and, although it is driven by mechanism disposed interiorly of the bristles beneath the brush body, will not stall during normal sweeping operation or when the sweeper is moved along the edge of the floor adjacent a wall. A further purpose of the present invention is to minimize the rotary brushcarpet frictional forces when the sweeper is moved across the floor.

In accordance with one aspect of the invention, there is provided within and beneath the generally conical array of sweeping brush bristles a flexible drive ring of frictional rubber-like material which drivingly engages the floor and which, upon downward force being applied to the sweeper, deforms upwardly against the brush bristles to deflect the latter in a direction away from the carpet to keep the brush-carpet friction forces generally equalized. This brush deflection is thus created by means independent of the floor. The planes of the ring and bristle tips are in parallelism and fixed relative to each other.

In accordance with another aspect of the invention, the auxiliary brush assembly is firmly mounted on a fixed axis on the sweeper frame so that both the drive ring and bristle tip planes are always at the same fixed angle and do not shift along said axis.

In accordance with a further aspect of the invention, the fixed axis is generally at 90° to the said drive ring and bristle tip planes and is also mounted at a substantial inclination from the vertical in a direction downwardly and transversely inwardly from the front sweeper frame corner. This construction causes the drive ring and auxiliary brush bristles to have a fixed tilt angle such that the drive ring and bristle tips continuously engage the floor along the outer side of the sweeper frame and are disengaged from the floor transversely inwardly of the said frame.

Because of the construction described, the auxiliary brush will be driven by an internal mechanism in a direction which is opposite from known devices. That is, upon forward sweeper movement, the rearward brush edge will rotate transversely inwardly beneath the sweeper housing and then forwardly. Thus, viewed from the top a right from corner brush will rotate clockwise and a left front corner brush will rotate counterclockwise. Each brush will sweep debris behind itself. This reversal of rotation from known brushes, when combined with the great incline of the brush axis, surprisingly provides excellent disturbing and loosening of the debris as well as sweeping of debris into the path of the roller brush, because a flicking action occurs.

The disclosed construction also prevents stalling of the brush during normal use and when the sweeper is used close to a wall.

DESCRIPTION OF THE DRAWINGS

The accompanying drawings illustrate the best mode presently contemplated by the inventor for carrying out the invention.

In the drawings:

FIG. 1 is a perspective view of a floor sweeper embodying the concepts of the invention, and with parts broken away;

FIG. 2 is an enlarged fragmentary top plan view of the front end portion of the sweeper, with parts broken away and showing the direction of rotation of the auxiliary brushes when the sweeper is moved forwardly and adjacent a wall;

FIG. 3 is an enlarged fragmentary bottom plan view of the front end portion of the sweeper;

FIG. 4 is an exploded sectional view of one of the auxiliary brush assemblies;

FIG. 5 is a vertical section of one of the assemblies taken on line 5—5 of FIG. 2; and FIG. 6 is a view similar to FIG. 5 and showing deformation of the drive ring and bristle deflection upon downward force being applied to the sweeper.

DESCRIPTION OF THE PREFERRED EMBODIMENT

As shown in FIGS. 1–3 of the drawings, the invention is embodied in a carpet sweeper having a housing or frame 1 which includes side and end walls 2 and 3 respectively, and a top 4. A suitable bail 5 is attached to frame 1 and has the usual handle, not shown. A plurality of supporting wheels 6 are suitably mounted to frame 1 and drive, through any suitable well-known connection, spaced front and rear elongated main brush rollers 7 and 8 which rotate about transverse horizontal axes.

It is contemplated that one or more auxiliary brush assemblies are suspended from and extend beyond the front corners of frame 1 to enable debris to be swept from outboard of the sweeper and inwardly into the path of brush rollers 7 and 8. In the present embodiment, two such assemblies are provided, 9 and 10 respectively. These assemblies are mounted to the ends of an elongated transverse rigid support plate 11 which is fixedly secured to a reverse flange 12 on front end wall 3 and which is disposed on the underside of the sweeper.

Since both assemblies are structurally identical except for direction of inclination, only assembly 10 will be described in detail.

As best shown in FIG. 4, each assembly 10 comprises a circular brush holding body 13 having a top surface with a flat central bearing portion 14 and an angled peripheral portion 15. Body 13 also includes a flat bottom face 16 and an annular wall-like edge 17 which is inclined at about 10° from the axis 18 of a central opening 19 passing through the body. For purposes of sweeping the floor, the inner end portions of a plurality of circumferentially spaced brush bristle tufts 20 are anchored in edge 17. As shown, tufts 20 are disposed at 90° to edge 17, and thus extend downwardly at an ideal angle of about 20° from a plane 21 passing at right angles through axis 18. The annular array of tufts 20 thus form, with body 13, a generally inverted cup-shaped brush for engaging the floor. The bristle tuft tips are disposed in a further plane 22 which is disposed at 90° to axis 18.

It is also contemplated that brush assembly 10 be driven from within. For this purpose, a drive disc 23 is provided, with disc 23 comprising a flat thin central body portion 24 and a downwardly extending annular peripheral bead or drive ring 25 of greater thickness. Drive disc 23 is contemplated as being of soft flexible resilient rubber-like material, such as polyurethane, and with a Durometer of about 90-Shore A. The surface of disc 23 should be of sufficient friction characteristics so that ring 25 engages and holds to a carpet or smooth floor without slipping.

Referring to FIGS. 4 and 5, drive disc body 24 is clamped and held to face 16 of brush body 13, as by a rigid annular flange 26 disposed on one end of a tubular bearing 27, with the latter being press fit or otherwise secured through brush body opening 19. The sandwich construction thus positions drive ring 25 so that it is concentric to and disposed radially inwardly of the brush bristle tips. As shown in FIG. 5, ring 25 extends radially outwardly from brush body 13 and is disposed adjacent the inner end portions of bristle tufts 20 and closely beneath the tufts.

Drive ring 25 is fixed relative to tufts 20, and is contained in a fixed plane 28 which is spaced from and parallel to plane 22.

It is further contemplated that the corner brushes disclosed herein will rotate in a direction opposite from previously known brushes of this type, will flick or whisk the debris into the path of the brush roller, and yet will operate continuously against a wall and without stalling. As best shown in FIG. 5, brush assembly 10 is mounted on a fixed axis 29 which is inclined substantially from the vertical. Axis 29 coincides with axis 18 and is defined by a downwardly extending axle 30 which is secured to a bent end portion 31 of support plate 11, as by riveting. The inner end portion of axle 30 is flanged to provide a bearing surface, as at 32. Portion 31 is bent so that axle 30 is inclined downwardly and inwardly transversely of sweeper frame 1. An angle of inclination from the vertical of about 12°–16° has been found to be very satisfactory. Bearing 27 is mounted over axle 30 so that brush body top surface portion 14 engages axle flange 32, as by a holding screw 33 which is tightened so as to permit free brush rotation but prevents any appreciable axial shifting of the brush.

Referring to FIGS. 2 and 5, when the sweeper is moved forwardly over the floor, ring 25 will engage the floor and drive right front brush assembly 10 clockwise. The relatively great fixed angle of brush inclination will cause the outer side brush bristles to whisk debris rearwardly and inwardly between front wall 3 and brush roller 7. Furthermore, as best shown in FIG. 2, when the sweeper is moved along a wall 34, the bristles of brush assembly 10 may deform against the wall but will continue to rotate and perform the desired function, because the brush tends to roll along the wall.

An additional important feature of the corner brush is that downward forces on the sweeper will not cause the brush bristle tips to dig into the carpet, even though the brush is fixed against axial movement. This is accomplished by the flexibility of drive ring 25. Referring to FIG. 6, normal downward force on the sweeper will cause the outer transverse ring portion to deform upwardly into engagement with the inner end portions of the tufts 20 disposed directly above. This action will, in turn, bias the tufts in a direction away from the carpet, but not out of contact therewith. The greater the downward sweeper force, the greater will be the upward ring deformation and brush biasing action, thus substantially equalizing the frictional forces between the brush and carpet. The result is that the force required to push the sweeper will increase very little, if at all, as downward force is applied by the operator.

The auxiliary brush device disclosed herein is constructed in a manner which is much simpler and less expensive than prior known devices, but is made in such a way that, even with an internal drive, it will not stall, even against a wall, and will be easier to push.

Various modes of carrying out the invention are contemplated as being within the scope of the following claims particularly pointing out and distinctly claiming the subject matter which is regarded as the invention.

I claim:

1. A carpet sweeper comprising:

a. a frame, b. means for supporting said frame for reciprocable translation over the floor, c. transversely extending brush roller means, d. at least one generally inverted cup-shaped circular auxiliary brush disposed at and extending beyond a forward corner of said frame and adapted to engage the floor, and with said auxiliary brush being rotatable about an axis which is inclined from the vertical, e. said auxiliary brush being fixed against substantial movement along said axis, f. and means mounted beneath said auxiliary brush to bias the brush bristles in a direction away from the floor upon the application of downward force on the sweeper to thereby keep the friction between said auxiliary brush and the floor generally equalized.

2. The carpet sweeper of claim 1 in which said brush biasing means comprises: a flexible member engageable with the floor and deformable upwardly into biasing engagement with the said brush bristles when downward force is applied to the sweeper.

3. The carpet sweeper of claim 2 in which said flexible member comprises means to rotatably drive said auxiliary brush about said axis.

4. The carpet sweeper of claim 3 in which said flexible member comprises a friction drive ring mounted concentric with said auxiliary brush and disposed closely adjacent the bristles thereof.

5. The carpet sweeper of claim 4 in which said axis is fixed and inclined downwardly from said frame and transversely inwardly so that said ring and brush assume a fixed angle to the vertical whereby the outer transverse edge portions of said ring and brush engage the floor while the inner transverse edge portions thereof are disengaged therefrom, the construction being such that upon forward movement of said sweeper, said auxiliary brush rotates to whisk debris behind itself and into the path of said brush roller means.

6. The carpet sweeper of claim 5 in which the angle of inclination of said axis is about 12°–16°.

7. The sweeper of claim 4:

a. in which the inner end portions of the bristles of said brush are rooted in the edge of a brush body, b. in which said drive ring forms the peripheral portion of a drive disc, c. and which includes means to clamp said drive disc to said brush body so that said drive ring is exposed and extends radially outwardly from the latter.

8. The sweeper of claim 7 in which said drive ring is disposed adjacent the said inner end portions of the bristles of said brush.

9. A floor sweeper comprising:

a. a frame, b. means supporting said frame for reciprocable translation over the floor, c. transversely extending brush roller means, d. at least one generally inverted cup-shaped circular auxiliary brush disposed at and extending beyond a forward corner of said frame and adapted to engage the floor, e. an annular drive ring disposed within and beneath said brush and concentric therewith, said ring being fixed relative to said brush and being adapted to engage the floor to rotatably drive said brush, f. means to suspend said brush and drive ring from said frame and for rotation about an axis, g. said axis being fixed and inclined downwardly from said frame and transversely inwardly so that said ring and brush assume a fixed angle to the vertical whereby the outer transverse edge portions of said ring and brush engage the floor while the inner transverse edge portions thereof are disengaged therefrom, h. the construction being such that upon forward movement of said sweeper, said auxiliary brush rotates to whisk debris behind itself and into the path of said brush roller means.

10. The sweeper of claim 9 in which said ring and the tips of the bristles of said brush are disposed in spaced parallel planes which are fixed relative to each other and disposed angularly to said axis.

11. The sweeper of claim 10 in which said ring and brush are fixed against substantial movement along said axis.

12. The sweeper of claim 9 in which said drive ring is flexible and resilient.

13. The sweeper of claim 9:

a. in which the inner end portions of the bristles of said brush are rooted in the edge of a brush body, b. in which said drive ring forms the peripheral portion of a drive disc, c. and which includes means to clamp said drive disc to said brush body so that said drive ring is exposed and extends radially outwardly from the latter.

14. The sweeper of claim 13 in which said drive ring is disposed adjacent the said inner end portions of the bristles of said brush.

* * * * *